US006132298A

United States Patent [19]

Zuniga et al.

[11] Patent Number: 6,132,298

[45] Date of Patent: Oct. 17, 2000

[54] CARRIER HEAD WITH EDGE CONTROL FOR CHEMICAL MECHANICAL POLISHING

[75] Inventors: Steven Zuniga, Soquel; Hung Chen, San Jose; Gopalakrishna B. Prabhu, San Francisco, all of Calif.

[73] Assignee: Applied Materials, Inc., Santa Clara, Calif.

[21] Appl. No.: 09/200,492

[22] Filed: Nov. 25, 1998

[51] Int. Cl.[7] ..... B24B 7/22

[52] U.S. Cl. ..... 451/288; 451/398; 451/41

[58] Field of Search ..... 451/288, 287, 451/285, 41, 398, 388

[56] References Cited

U.S. PATENT DOCUMENTS

| | | | |
|---|---|---|---|
| 4,918,869 | 4/1990 | Kitta | 51/131.1 |
| 5,205,082 | 4/1993 | Shendon et al. | 51/283 |
| 5,423,558 | 6/1995 | Koeth et al. | 279/3 |
| 5,423,716 | 6/1995 | Strasbaugh | 451/388 |
| 5,527,209 | 6/1996 | Volodarsky et al. | 451/388 |
| 5,584,751 | 12/1996 | Kobayashi et al. | 451/288 |
| 5,605,488 | 2/1997 | Ohashi et al. | 451/7 |
| 5,624,299 | 4/1997 | Shendon | 451/28 |
| 5,643,053 | 7/1997 | Shendon | 451/28 |
| 5,643,061 | 7/1997 | Jackson et al. | 451/289 |
| 5,695,392 | 12/1997 | Kim | 451/288 |
| 5,720,845 | 2/1998 | Liu | 156/345 |
| 5,733,182 | 3/1998 | Muramatsu et al. | 451/289 |
| 5,762,539 | 6/1998 | Nakashiba et al. | 451/41 |
| 5,803,799 | 9/1998 | Volodarsky et al. | 451/288 |
| 5,851,140 | 12/1998 | Barns et al. | 451/288 |

FOREIGN PATENT DOCUMENTS

| | | | |
|---|---|---|---|
| 5069310 | 3/1993 | Japan | 451/41 |
| 6091522 | 4/1994 | Japan | 451/288 |

*Primary Examiner*—Robert A. Rose
*Attorney, Agent, or Firm*—Fish & Richardson

[57] ABSTRACT

A carrier head, particularly suited for chemical mechanical polishing of a flatted substrate, includes a flexible membrane and an edge load ring. A lower surface of the flexible membrane provides a receiving surface for a center portion of the substrate, whereas a lower surface of the edge load ring provides a receiving surface for a perimeter portion of the substrate. A slurry suitable for chemical mechanical polishing a flatted substrate includes water, a colloidal silica that tends to agglomerate, and a fumed silica that tends not to agglomerate.

32 Claims, 12 Drawing Sheets

CARRIER HEAD WITH EDGE CONTROL FOR CHEMICAL MECHANICAL POLISHING

BACKGROUND

The present invention relates generally to chemical mechanical polishing of substrates, and more particularly to a carrier head for chemical mechanical polishing.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" or a fixed-abrasive pad. A standard polishing pad has a durable roughened surface, whereas a fixed-abrasive pad has abrasive particles held in a containment media. The carrier head provides a controllable load, i.e., pressure, on the substrate to push it against the polishing pad. Some carrier heads include a flexible membrane that provides a mounting surface for the substrate, and a retaining ring to hold the substrate beneath the mounting surface. Pressurization or evacuation of a chamber behind the flexible membrane controls the load on the substrate. A polishing slurry, including at least one chemically-reactive agent, and abrasive particles, if a standard pad is used, is supplied to the surface of the polishing pad.

The effectiveness of a CMP process may be measured by its polishing rate, and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad.

A reoccurring problem in CMP is the so-called "edge-effect," i.e., the tendency of the substrate edge to be polished at a different rate than the substrate center. The edge effect typically results in overpolishing (the removal of too much material from the substrate) at the substrate perimeter, e.g., the outermost five to ten millimeters of a 200 millimeter (mm) wafer.

Another related problem, specifically in the polishing of so-called "flatted" substrates, i.e., substrates with a flat perimeter portion, is overpolishing of a region located adjacent the flat. In addition, the corners of the flat are often overpolished. Overpolishing reduces the overall flatness of the substrate, causing the edge, corners and flat of the substrate to be unsuitable for integrated circuit fabrication and decreasing process yield.

Another problem, particularly in polishing of flatted wafers using a carrier with a flexible membrane, is that the wafer flat contacts and abrades the bottom surface of the membrane, thereby reducing the membrane lifetime.

SUMMARY

In general, in one aspect, the invention is directed to a carrier head for chemical mechanical polishing. The carrier head has a base, a flexible membrane extending beneath the base to define a pressurizable chamber, an edge load ring, and a retaining ring. A lower surface of the flexible membrane provides a first surface for applying a first load to a center portion of a substrate. A lower surface of the edge load ring provides a second surface for applying a second load to perimeter portion of the substrate. The retaining ring surrounds the edge load ring to maintain the substrate beneath the first and second surfaces.

Implementations of the invention may include one or more of the following. The flexible membrane may be joined to a support structure, and the support structure may be movably connected to the base by a flexure. The flexible membrane may extend between an outer surface of the support structure and an inner surface of the edge load ring. A rim portion of the edge load ring may abut the support structure to maintain a gap between the inner surface of the edge load ring and the flexible membrane, and may extend over a portion of the support structure. A top surface of the edge load ring may abut a lower surface of the flexure, and pressurization of the chamber may apply a downward force on the edge load ring through the flexure. The surface area of the top surface of the edge load ring may be greater or less than the surface area of the lower surface of the edge load ring. An outer edge of the flexure may be clamped between the retaining ring and the base. An annular flexure support may be removably connected to the retaining ring and may support a perimeter portion of the flexure. The flexure support may be formed as an integral part of the retaining ring. The edge load ring may be joined to the support structure.

The support structure may include a support plate, a lower clamp, and an upper clamp, and the flexible membrane may be clamped between the support plate and the lower clamp. The flexure may be clamped between the lower clamp and the upper clamp, and the edge load ring may be joined to the lower clamp. The carrier head may have a layer of compressible material disposed on the lower surface of the edge load ring. The lower surface of the edge load ring may include an annular projection with an inner diameter which is larger than an outer diameter of the first surface. The edge load ring may include an annular flange located inwardly of the annular projection and may protrude downwardly to prevent the flexible membrane from extending beneath the edge load ring. The edge load ring may be configured to extend over a flat of the substrate. The lower surface of the edge load ring may include an annular projection which may extend over at least a portion of the flat. The carrier head may be constructed so that$(RI+RO)/2>RF$, where RI represents an inner radius of the annular projection, RO represents an outer radius of the annular projection, and RF represents the distance between the substrate center and the substrate flat.

A second edge load ring may surround the second surface, and a lower surface of the second edge load ring may provide a third surface for applying a third load to a second perimeter portion of the substrate. A third edge load ring may surround the third surface, and a lower surface of the third edge load ring may provide a fourth surface for applying a fourth load to a third perimeter portion of the substrate. A portion of the flexible membrane may extend beneath the lower surface of the edge load ring, may include a plurality of grooves, and may be secured to the edge load ring. An outer surface of the edge load ring may be separated from an inner surface of the retaining ring by a gap positioned such that frictional forces between the substrate and a polishing pad may urge a trailing edge of the substrate into the gap.

In another aspect, the invention is directed to a carrier head for chemical mechanical polishing. The carrier head has a base, a flexible membrane, and a rigid member. The flexible membrane extends beneath the base to define a pressurizable chamber, and a lower surface of the flexible membrane provides a first surface for applying a first load to a first portion of the substrate. The rigid member is movable relative to the base, and a lower surface of the rigid member provides a second surface for applying a second load to a second portion of the substrate.

In another aspect, the invention is directed to a method of polishing a substrate. In the method, the substrate is brought into contact with a polishing surface, a first load is applied to a center portion of the substrate with a flexible membrane, and a second load is applied to a perimeter portion of the substrate with an edge load ring that is more rigid than the flexible membrane.

In another aspect, the invention is directed to a chemical mechanical polishing carrier head part. The part has an annular main body portion and a flange portion. An annular projection extends downwardly from the main body portion and has a lower surface to contact a perimeter portion of a substrate. The flange portion projects upwardly from the main body portion and has an inwardly projecting rim to catch on a part of the carrier head.

In another aspect, the invention is directed to a method of chemical mechanical polishing a substrate. The substrate is brought into contact with a polishing surface, a slurry is supplied to an interface between the substrate and the polishing surface, and relative motion is created between the substrate and the polishing surface. The slurry includes a first silica that tends to agglomerate and a second silica that tends not to agglomerate.

Implementations of the invention may include the following. The first silica may be a fumed silica, and the second silica may be a colloidal silica. The colloidal silica may be about 1 to 99 percent, e.g., 35 percent, by volume of solids of the silica in the slurry. The slurry may be formed by mixing a colloidal silica slurry with a fumed silica slurry. The colloidal silica slurry may be about 1 to 99 percent, e.g., 50 percent, by volume of the slurry. A surface of the substrate may include a layer of an oxide, and the polishing surface may be a rotatable polishing pad. The substrate may have a flatted edge portion.

In another aspect, the invention is directed to a method of chemical mechanical polishing in which a substrate having a flatted edge is brought into contact with a polishing surface, a slurry is supplied to an interface between the substrate and the polishing surface, and relative motion is created between the substrate and the polishing surface. The slurry includes a colloidal silica that tends not to agglomerate.

In another aspect, the invention is directed to a slurry for chemical mechanical polishing. The slurry includes water, a colloidal silica that tends to agglomerate, a fumed silica that tends not to agglomerate, and a pH adjustor.

Advantages of the invention may include the following. Overpolishing of the edge, flat and corners of the substrate is reduced, and the resulting flatness and finish of the substrate are improved. Wear on the membrane is decreased so that the membrane lifetime is increased.

Other advantages and features of the invention will be apparent from the following description, including the drawings and claims.

BRIEF DESCRIPTION OF THE DRAWINGS

Like reference numbers are designated in the various drawings to indicate like elements. A reference number with a letter suffix indicates that an element has a modified function, operation or structure.

DETAILED DESCRIPTION

Figure 1:
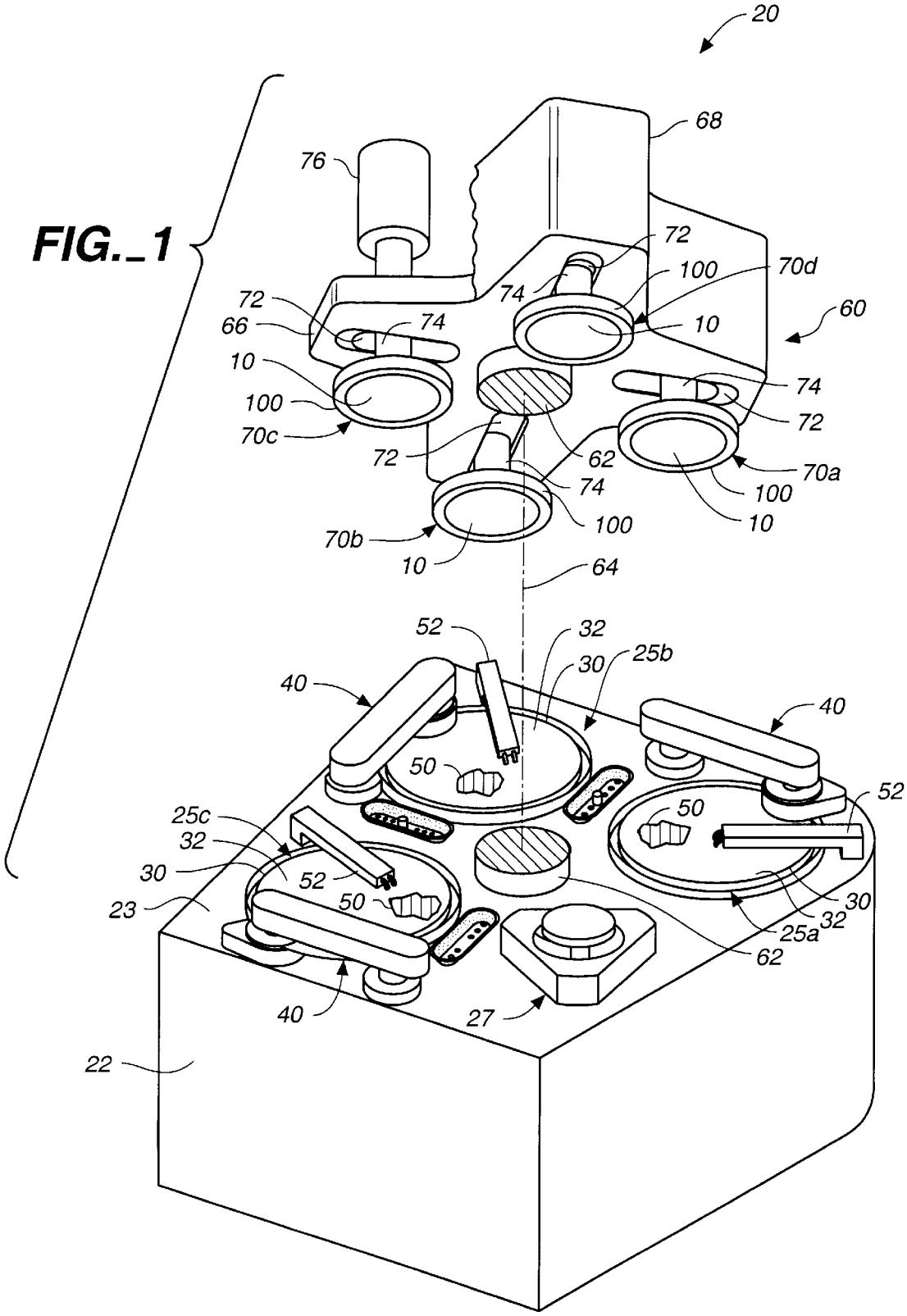
FIG. 1 is an exploded perspective view of a chemical mechanical polishing apparatus.

Referring to FIG. 1, one or more substrates 10 will be polished by a chemical mechanical polishing (CMP) apparatus 20. A description of a similar CMP apparatus may be found in U.S. Pat. No. 5,738,574, the entire disclosure of which is hereby incorporated by reference.

The CMP apparatus 20 includes a lower machine base 22 with a table top 23 mounted thereon and a removable upper outer cover (not shown). Table top 23 supports a series of polishing stations 25, and a transfer station 27 for loading and unloading the substrates. The transfer station may form a generally square arrangement with the three polishing stations.

Each polishing station 25 includes a rotatable platen 30 on which is placed a polishing pad 32. If substrate 10 is a "six-inch" (150 millimeter) or "eight-inch" (200 millimeter) diameter disk, then platen 30 and polishing pad 32 may be about twenty inches in diameter. If substrate 10 is a "twelve-inch" (300 millimeter) diameter disk, then platen 30 and polishing pad 32 may be about thirty inches in diameter. Platen 30 may be connected to a platen drive motor (not shown) located inside machine base 22. For most polishing processes, the platen drive motor rotates platen 30 at thirty to two-hundred revolutions per minute, although lower or higher rotational speeds may be used. Each polishing station 25 may further include an associated pad conditioner apparatus 40 to maintain the abrasive condition of the polishing pad.

Polishing pad 32 may be a composite material with a roughened polishing surface. The polishing pad 32 may be attached to platen 30 by a pressure-sensitive adhesive layer. Polishing pad 32 may have a fifty mil thick hard upper layer and a fifty mil thick softer lower layer. The upper layer is preferably a material composed of polyurethane mixed with other fillers. The lower layer is preferably a material composed of compressed felt fibers leached with urethane. A common two-layer polishing pad, with the upper layer composed of IC-1000 and the lower layer composed of SUBA-4, is available from Rodel, Inc., located in Newark, Del. (IC-1000 and SUBA-4 are product names of Rodel, Inc.).

A slurry 50 containing a reactive agent (e.g., deionized water for oxide polishing) and a chemically-reactive catalyzer (e.g., potassium hydroxide for oxide polishing) may be supplied to the surface of polishing pad 32 by a combined slurry/rinse arm 52. If polishing pad 32 is a standard pad, slurry 50 may also include abrasive particles (e.g., silicon dioxide for oxide polishing). Typically, sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

A rotatable multi-head carousel 60, including a carousel support plate 66 and a cover 68, is positioned above lower machine base 22. Carousel support plate 66 is supported by a center post 62 and rotated thereon about a carousel axis 64 by a carousel motor assembly located within machine base 22. Multi-head carousel 60 includes four carrier head systems 70 mounted on carousel support plate 66 at equal angular intervals about carousel axis 64. Three of the carrier head systems receive and hold substrates and polish them by pressing them against the polishing pads of polishing stations 25. One of the carrier head systems receives a substrate from and delivers the substrate to transfer station 27. The carousel motor may orbit carrier head systems 70, and the substrates attached thereto, about carousel axis 64 between the polishing stations and the transfer station.

Each carrier head system 70 includes a polishing or carrier head 100. Each carrier head 100 independently rotates about its own axis, and independently laterally oscillates in a radial slot 72 formed in carousel support plate 66. A carrier drive shaft 74 extends through slot 72 to connect a carrier head rotation motor 76 (shown by the removal of one-quarter of cover 68) to carrier head 100. There is one carrier drive shaft and motor for each head. Each motor and drive shaft may be supported on a slider (not shown) which can be linearly driven along the slot by a radial drive motor to laterally oscillate the carrier head.

During actual polishing, three of the carrier heads, are positioned at and above the three polishing stations. Each carrier head 100 lowers a substrate into contact with a polishing pad 32. Generally, carrier head 100 holds the substrate in position against the polishing pad and distributes a force across the back surface of the substrate. The carrier head also transfers torque from the drive shaft to the substrate.

Figure 2:
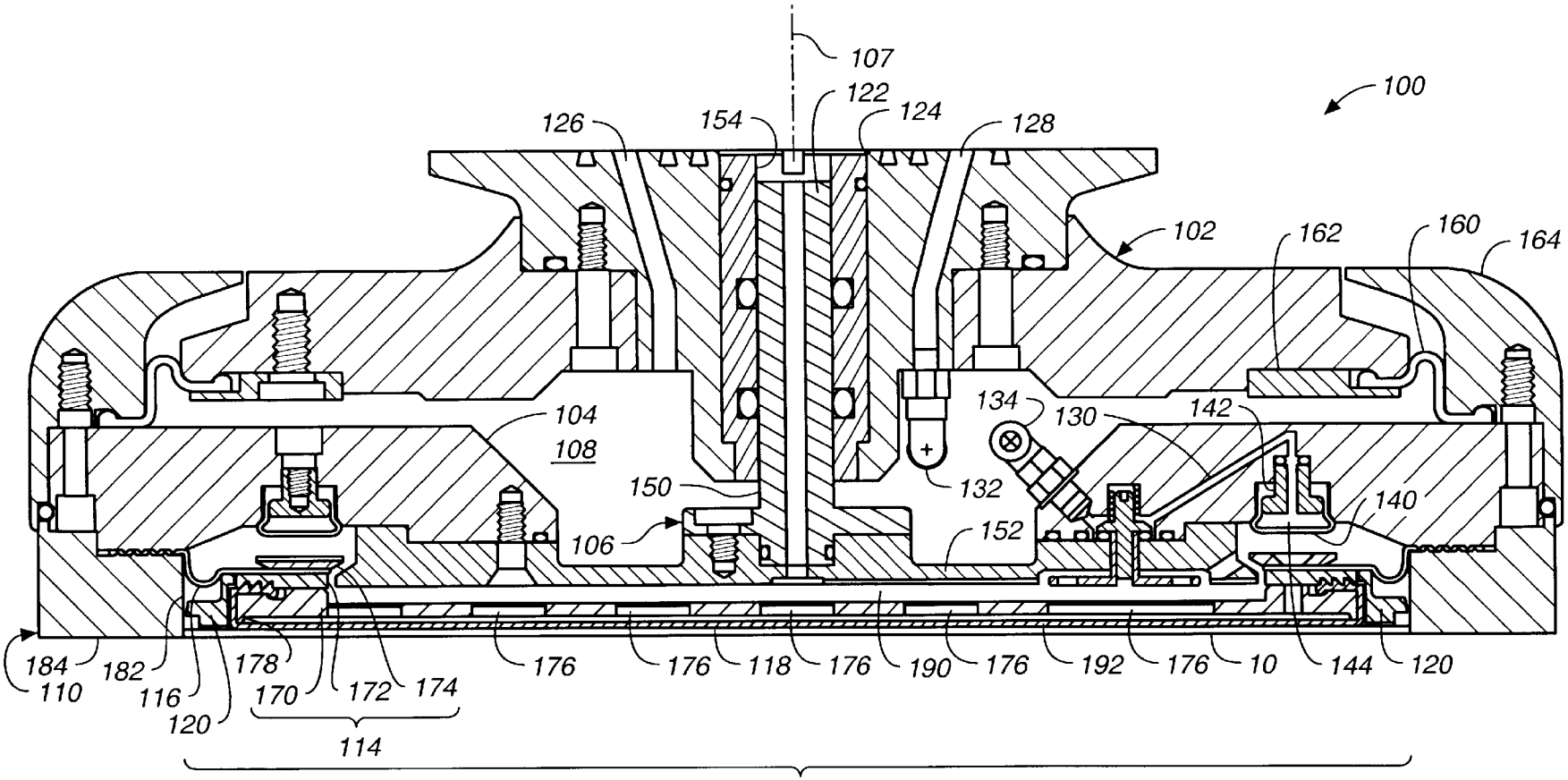
FIG. 2 is a schematic cross-sectional view of a carrier head according to the present invention.
Figure 3:
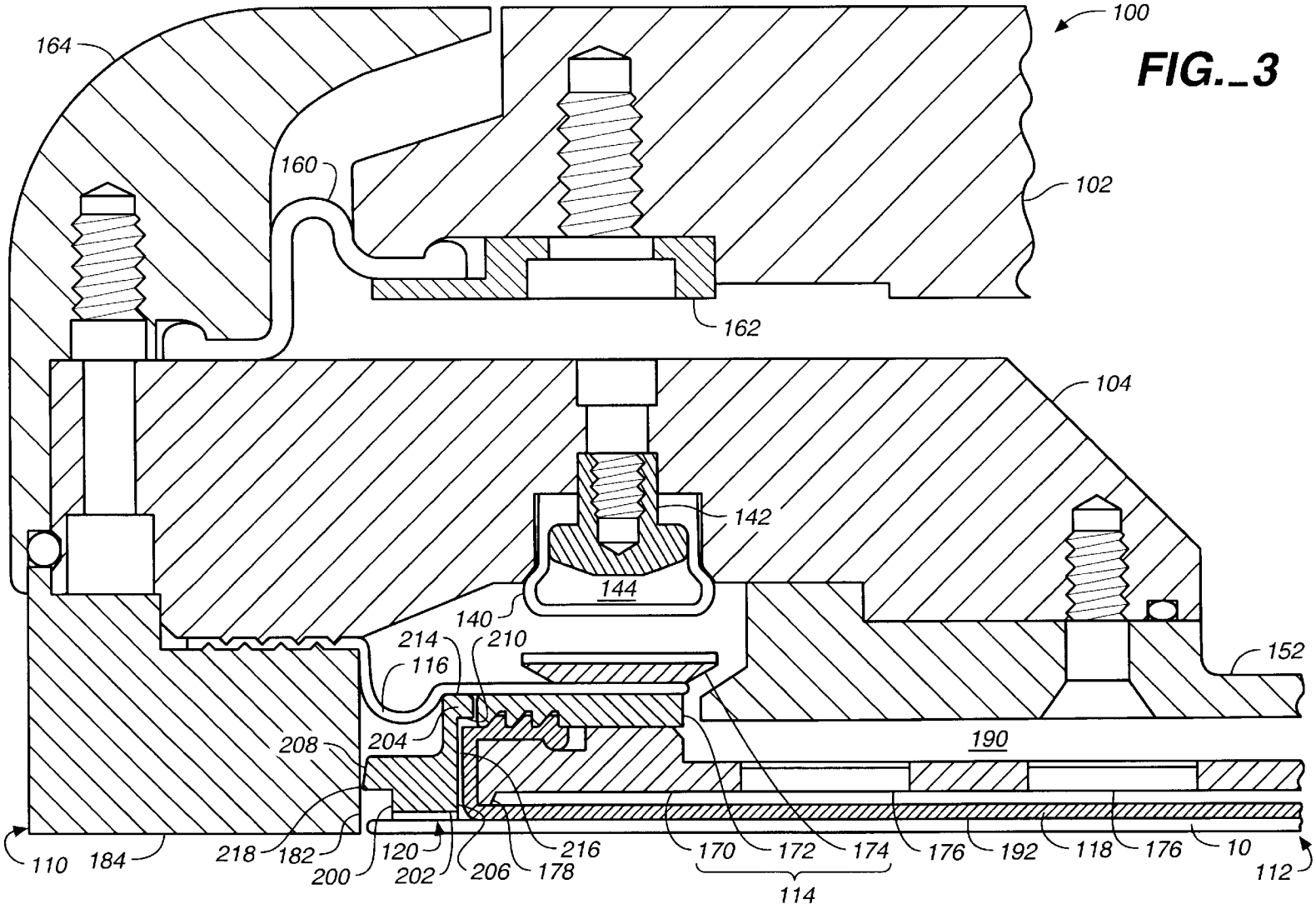
FIG. 3 is an enlarged view of the carrier head of FIG. 2 showing an edge-load ring.

Referring to FIGS. 2 and 3, carrier head 100 includes a housing 102, a base 104, a gimbal mechanism 106, a loading chamber 108, a retaining ring 110, and a substrate backing assembly 112. A description of a similar carrier head may be found in U.S. application Ser. No. 08/745,670 by Zuniga, et al., filed Nov. 8, 1996, entitled a CARRIER HEAD WITH a FLEXIBLE MEMBRANE FOR a CHEMICAL MECHANICAL POLISHING SYSTEM, and assigned to the assignee of the present invention, the entire disclosure of which is hereby incorporated by reference.

Housing 102 can be connected to drive shaft 74 to rotate therewith during polishing about an axis of rotation 107 which is substantially perpendicular to the surface of the polishing pad during polishing. Loading chamber 108 is located between housing 102 and base 104 to apply a load, i.e., a downward pressure, to base 104. The vertical position of base 104 relative to polishing pad 32 is also controlled by loading chamber 108.

Housing 102 may be generally circular in shape to correspond to the circular configuration of the substrate to be polished. A cylindrical bushing 122 may fit into a vertical bore 124 through the housing, and two passages 126 and 128 may extend through the housing for pneumatic control of the carrier head.

Base 104 is a generally ring-shaped body located beneath housing 102. Base 104 may be formed of a rigid material such as aluminum, stainless steel or fiber-reinforced plastic. A passage 130 may extend through the base, and two fixtures 132 and 134 may provide attachment points to connect a flexible tube between housing 102 and base 104 to fluidly couple passage 128 to passage 130.

Substrate backing assembly 112 includes a support structure 114, a flexure diaphragm 116 connecting support structure 114 to base 104, a flexible member or membrane 118 connected to support structure 114 and an edge-load ring 120. Flexible membrane 118 extends below support structure 114 to provide a surface 192 engaging a center portion of the substrate, whereas edge-load ring 120 extends around the support structure to provide a surface 202 for engaging a perimeter portion of the substrate. Pressurization of a chamber 190 positioned between base 104 and substrate backing assembly 112 forces flexible membrane 118 downwardly to press the center portion of the substrate against the polishing pad. Pressurization of chamber 190 also forces flexure diaphragm 116 downwardly against edge-load ring 120 to press the perimeter portion of the substrate against the polishing pad.

An elastic and flexible membrane 140 may be attached to the lower surface of base 104 by a clamp ring 142 to define a bladder 144. Clamp ring 142 may be secured to base 104 by screws or bolts (not shown). A first pump (not shown) may be connected to bladder 144 to direct a fluid, e.g., a gas, such as air, into or out of the bladder and thereby control a downward pressure on support structure 114. Specifically, bladder 144 may be used to cause lip 178 of support plate 170 to press the edge of flexible membrane 118 against substrate 10, thereby creating a fluid-tight seal to ensure vacuum-chucking of the substrate to the flexible membrane when chamber 190 is evacuated.

Gimbal mechanism 106 permits base 104 to pivot with respect to housing 102 so that the base may remain substantially parallel with the surface of the polishing pad. Gimbal mechanism 106 includes a gimbal rod 150 which fits into a passage 154 through cylindrical bushing 122 and a flexure ring 152 which is secured to base 104. Gimbal rod 150 may slide vertically along passage 154 to provide vertical motion of base 104, but it prevents any lateral motion of base 104 with respect to housing 102.

An inner edge of a rolling diaphragm 160 may be clamped to housing 102 by an inner clamp ring 162, and an outer clamp ring 164 may clamp an outer edge of rolling diaphragm 160 to base 104. Thus, rolling diaphragm 160 seals the space between housing 102 and base 104 to define loading chamber 108. Rolling diaphragm 160 may be a generally ring-shaped sixty mil thick silicone sheet. A second pump (not shown) may be fluidly connected to loading chamber 108 to control the pressure in the loading chamber and the load applied to base 104.

Support structure 114 of substrate backing assembly 112 includes a support plate 170, an annular lower clamp 172, and an annular upper clamp 174. Support plate 170 may be a generally disk-shaped rigid member having a plurality of apertures 176 formed therethrough. In addition, support plate 170 may have a downwardly-projecting lip 178 at its outer edge.

Flexure diaphragm 116 of substrate backing assembly 112 is a generally planar annular ring. An inner edge of flexure diaphragm 116 is clamped between base 104 and retaining ring 110, and an outer edge of flexure diaphragm 116 is clamped between lower clamp 172 and upper clamp 174. Flexure diaphragm 116 is flexible and elastic, although it could be rigid in the radial and tangential directions. Flexure diaphragm 116 may formed of rubber, such as neoprene, chloroprene, ethylene propylene or silicone, an elastomeric-coated fabric, such as NYLON™ or NOMEX™, plastic, or a composite material, such as fiberglass.

Flexible membrane 118 is a generally circular sheet formed of a flexible and elastic material, such as neoprene, chloroprene, ethylene propylene or silicone rubber. A portion of flexible membrane 118 extends around the edges of support plate 170 to be clamped between the support plate and lower clamp 172.

The sealed volume between flexible membrane 118, support structure 114, flexure diaphragm 116, base 104, and gimbal mechanism 106 defines pressurizable chamber 190. A third pump (not shown) may be fluidly connected to chamber 190 to control the pressure in the chamber and thus the downward forces of the flexible membrane on the substrate.

Retaining ring 110 may be a generally annular ring secured at the outer edge of base 104, e.g., by bolts (not shown). When fluid is pumped into loading chamber 108 and base 104 is pushed downwardly, retaining ring 110 is also pushed downwardly to apply a load to polishing pad 32. A bottom surface 184 of retaining ring 110 may be substantially flat, or it may have a plurality of channels to facilitate transport of slurry from outside the retaining ring to the substrate. An inner surface 182 of retaining ring 110 engages the substrate to prevent it from escaping from beneath the carrier head.

Edge-load ring 120 is a generally annular body located between retaining ring 110 and support structure 114. Edge-load ring 120 includes a base portion 200 having a substantially flat lower surface 202 for applying pressure to a perimeter portion of substrate 10. Edge-load ring 120 is composed of a material, such as a stainless steel, ceramic, anodized aluminum, or plastic, e.g., polyphenylene sulfide (PPS), that is relatively rigid compared to the flexible membrane. A layer 212 of compressible material, such as a carrier film, may be adhesively attached to lower surface 202 of base portion 200 to provide a mounting surface for substrate 10.

A cylindrical inner surface 206 of edge-load ring 120 is located adjacent to the portion of flexible membrane 118 which extends around the edge of support plate 170. The inner surface 206 may be separated from flexible membrane 118 by a small gap 216 to prevent binding between the edge-load ring and the flexible membrane. An outer surface 208 of edge-load ring 120 is angled to reduce the surface contact area between the edge-load ring and the retaining ring. The outermost edge of outer surface 208 includes a generally vertical or rounded portion 218 to prevent the edge-load ring from scratching or damaging retaining ring 110.

Edge-load ring 120 also includes a rim portion 204 that extends above base portion 200 to contact flexure diaphragm 116. Rim portion 204 may include a lip 210 that extends over flexible membrane 118. Lip 210 may abut lower clamp 172 to maintain gap 216 between inner surface 206 and flexible membrane 118. The flexure diaphragm 116 contacts an upper surface 214 of rim portion 204.

In operation, fluid is pumped into chamber 190 to control the downward pressure applied by flexible membrane 118 against the center portion of the substrate. The pressure in chamber 190 also exerts a force on flexure diaphragm 116 to control the downward pressure applied by edge-load ring 120 against the perimeter portion of the substrate. When chamber 190 is pressurized, flexible membrane 118 will also expand laterally outward, and might contact the inner surface 182 of retaining ring 110.

When polishing is completed and loading chamber 108 is evacuated to lift base 104 and backing structure 112 off the polishing pad, the top surface of flexible membrane 118 engages lip 210 of edge-load ring 120 to lift edge-load ring 120 off the polishing pad with the rest of the carrier head.

As previously discussed, one reoccurring problem in CMP is overpolishing near the flat and along the edge of the substrate. Without being limited to any particular theory, one possible cause of this overpolishing is extension of the flexible membrane over the substrate edge. Specifically, referring to FIG. 11, if substrate 10 is smaller than the mounting surface provided by the flexible membrane, a portion of the flexible membrane will tend to wrap around substrate edge 12, thereby applying increased pressure. This effect may be particularly pronounced along substrate flat 14, where the distance between the substrate edge and the mounting surface edge is greater, resulting in overpolishing of a region 16 generally adjacent the flat. Another cause of overpolishing, particularly at corners 18 of the flat, is the point contact between the substrate corners and the retaining ring. Specifically, the rotating polishing pad tends to drive the substrate corners against the inner surface of the retaining ring, which can cause the substrate to deform or bend, thereby increasing the pressure and polishing rate at the corners.

However, returning to FIGS. 2 and 3, in carrier head 100, flexible membrane 118 applies a load to the central portion of the substrate, whereas edge-load ring 120 applies a load to a perimeter portion of the substrate. Since the edge-load ring is relatively rigid and cannot wrap around the substrate edge, a more uniform pressure is applied to the substrate perimeter, reducing overpolishing.

In addition, the pressure applied by edge-load ring 120 may differ from the pressure applied by flexible membrane 118. In short, the pressure from flexible membrane 118 may be selected to provide uniform polishing of the center portion of the substrate, while the pressure from edge-load ring 120 is selected to provide uniform polishing of the substrate flat and the edge. More specifically, by appropriately selecting the ratio of the surface area of upper surface 214 to the surface area of lower surface 202, the relative pressure applied to the substrate perimeter may be adjusted to reduce overpolishing. If the surface area of upper surface 214 is greater than the surface area of lower surface 202, then the edge-load ring will effectively increase the applied pressure, whereas if the surface area of upper surface 214 is less than the surface area of lower surface 202, then the edge-load ring will effectively decrease the applied pressure. Finally, the pressure on retaining ring 110 is selected to reduce the edge effect, as discussed in U.S. Pat. No. 5,795,215, the entire disclosure of which is hereby incorporated by reference.

Polishing of the substrate flat and corners is also affected by the selection of the slurry and polishing pad. When a standard polishing pad is used for oxide polishing, a slurry containing a colloidal silica appears to reduce overpolishing around the substrate flat and corners, thereby improving polishing uniformity. Without being limited to any particular theory, the improved polishing uniformity may be caused by the lower viscosity of slurries containing colloidal silica, which tend not to agglomerate, relative to slurries containing fumed silica, which do tend to agglomerate. This lower viscosity would tend to prevent slurry build-up at the corners and edge of the substrate, thereby ensuring more uniform distribution of the slurry across the substrate surface and improving polishing uniformity.

To provide a viscosity that reduces or minimizes polishing non-uniformity, the slurry may contain both a non-agglomerating silica, such as a colloidal silica, and a silica that tends to agglomerate, such as fumed silica. More specifically, slurry 50 may contain deionized water, a pH adjustor, such as potassium hydroxide (KOH), and a mixture of colloidal silica and fumed silica. For example, the colloidal silica may comprise about 1 to 99 percent, e.g., about 35 percent (by volume of solids), of the total silica in the slurry. Slurry 50 may also include other additives, such as etchants, oxidizers, corrosion inhibitors, biocides, stabilizers, polishing accelerators and retardants, and viscosity adjusters.

In general, the colloidal silica will tend not to agglomerate if the silica particles are "small" relative to fumed silica, e.g., about 50 nanometers (nm), have a narrow size distribution, and are substantially spherical in shape. In contrast, the fumed silica will tend to agglomerate because the silica particles are "large", e.g., 150–200 nm, have a wide size distribution, and are irregularly shaped.

Slurry 50 may be formed by mixing a colloidal silica slurry with a fumed silica slurry. A suitable slurry containing fumed silica is available from Cabot Corp., of Aurora, Ill., under the trade name SS-12, and a suitable slurry containing colloidal silica is available from Rodel, Inc., of Newark, Del., under the trade name KLEBOSOL. The SS-12 slurry is about 30% solids, whereas the KLEBOSOL slurry is about 12% solids. The SS-12 and KLEBOSOL slurries may be mixed to provide the desired concentration of colloidal and fumed silica. For example, the colloidal silica slurry may comprise about 1 to 99 percent, e.g., about 50% (by volume), of the slurry.

Figure 4A:
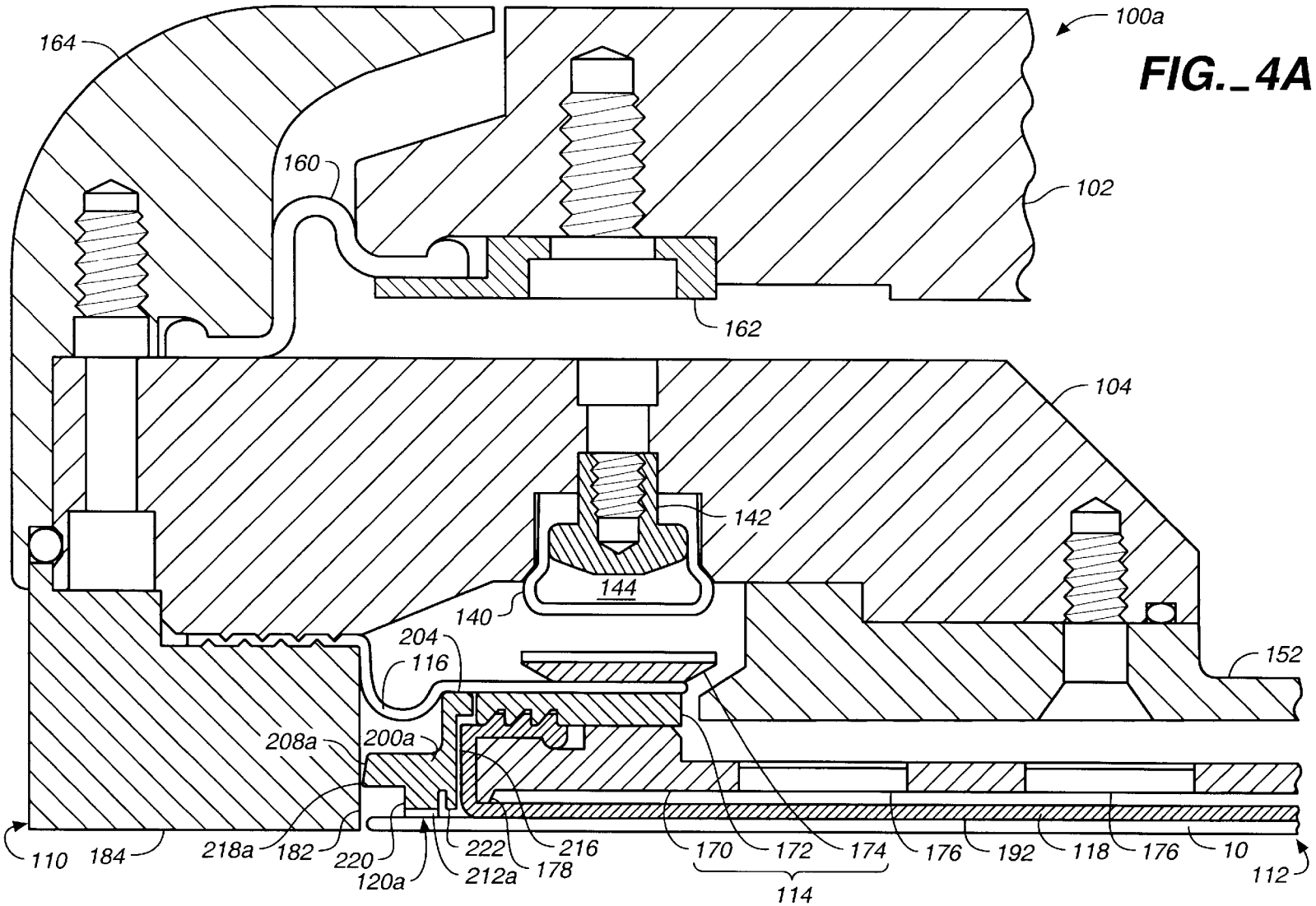
FIG. 4A is a cross-sectional view of a carrier head with an edge-load ring having an annular projection.
Figure 4B:
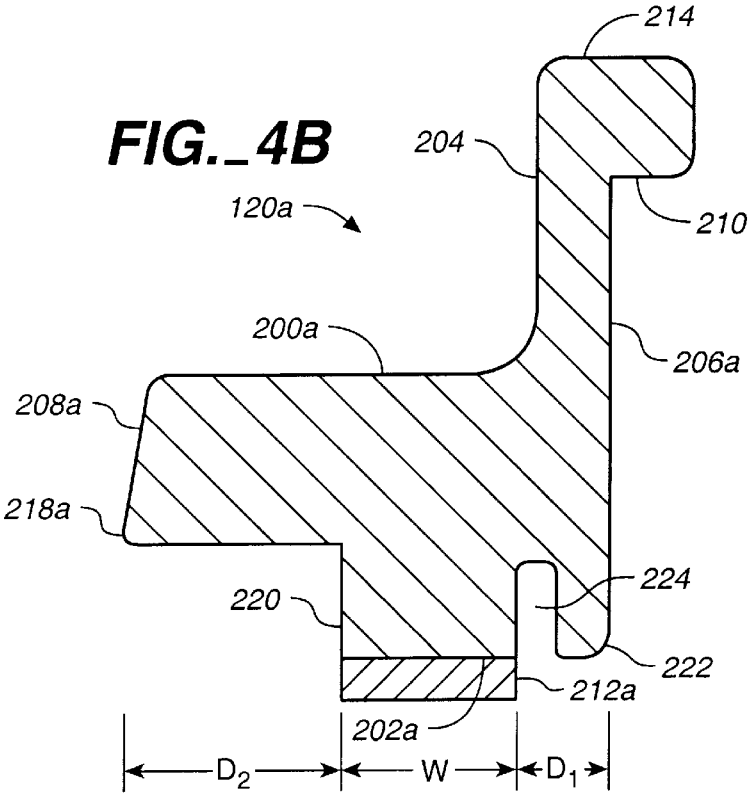
FIG. 4B is an enlarged view of the edge-load ring of FIG. 4A.

Referring to FIGS. 4A and 4B, in carrier head 100*a*, edge-load ring 120*a* has a generally annular projection 220 extending from base portion 200*a* to provide lower surface 202*a*. Annular projection 220 has a width W, and is located a distance $D_1$ from inner surface 206*a* and a distance $D_2$ from outer surface 208*a*. Edge-load ring 120*a* also includes an annular flange 222 which extends from inner surface 206*a* and is separated from annular projection 220 by a gap 224. Flange 222 prevents flexible membrane 118 from protruding below the edge-load ring and lifting it off the substrate. A layer 212*a* of compressible material may be adhesively attached to lower surface 202*a*.

Figure 11:
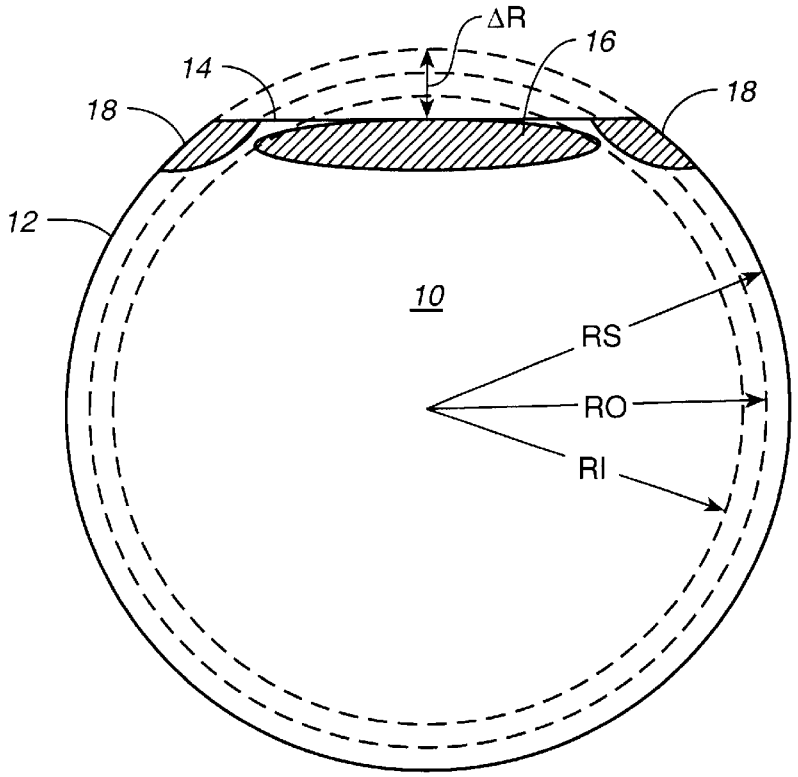
FIG. 11 is a top view of a flatted substrate.

By selecting the dimensions W, $D_1$ and $D_2$ the area of contact between the edge-load ring and the substrate may be adjusted to provide the optimal polishing performance. In general, moving the contact region inwards, i.e., decreasing $D_1$ or increasing $D_2$, reduces the removal rate at the substrate corners but increases the removal rate at the center of the flat. On the other hand, moving the contact region outwardly, i.e., increasing $D_1$ or decreasing $D_2$, reduces the removal rate at the center of the substrate flat but increases the removal rate at the corners. Specifically, the dimensions W, $D_1$ and $D_2$ may be selected so that the center of the contact area is outside the minimum radius of the substrate flat, i.e., $$(RI+RO)/2>RF=(RS-\Delta R)$$

where RI represents an inner radius of the annular projection, RO represents an outer radius of the annular projection, and RF represents the minimum distance between the substrate center and the substrate flat. The radius RF may be determined from $$RF=RS-\Delta R$$

where RS represents the radius of the outer edge of the substrate, and ΔR represents the maximum distance between the flat of the substrate and the outer edge of the substrate (see FIG. 11). In addition, the mounting surface provided by flexible membrane 118 should not extend beyond the substrate flat, so it is preferred that $D_1+W+D_2 \geqq \Delta R$. For example, if ΔR is about seven millimeters, then $D_1$ may be about two millimeters, W may be about five millimeters and $D_2$ may be about zero millimeters.

The dimensions of the edge-load ring (or load rings discussed with reference to FIG. 6 below) may also be selected to compensate for the "fast band effect". In general, this will require that the edge-load ring be relatively wide as compared to an edge-load ring used to reduce the "edge effect". For example, the inner diameter of the edge-load ring may be about 150 to 170 mm. In addition, the ratio of the surface areas of the upper and lower surfaces of the edge-load ring should be selected to effectively decrease the applied pressure, thereby reducing the polishing rate and compensating for the "fast band effect".

Figure 5:
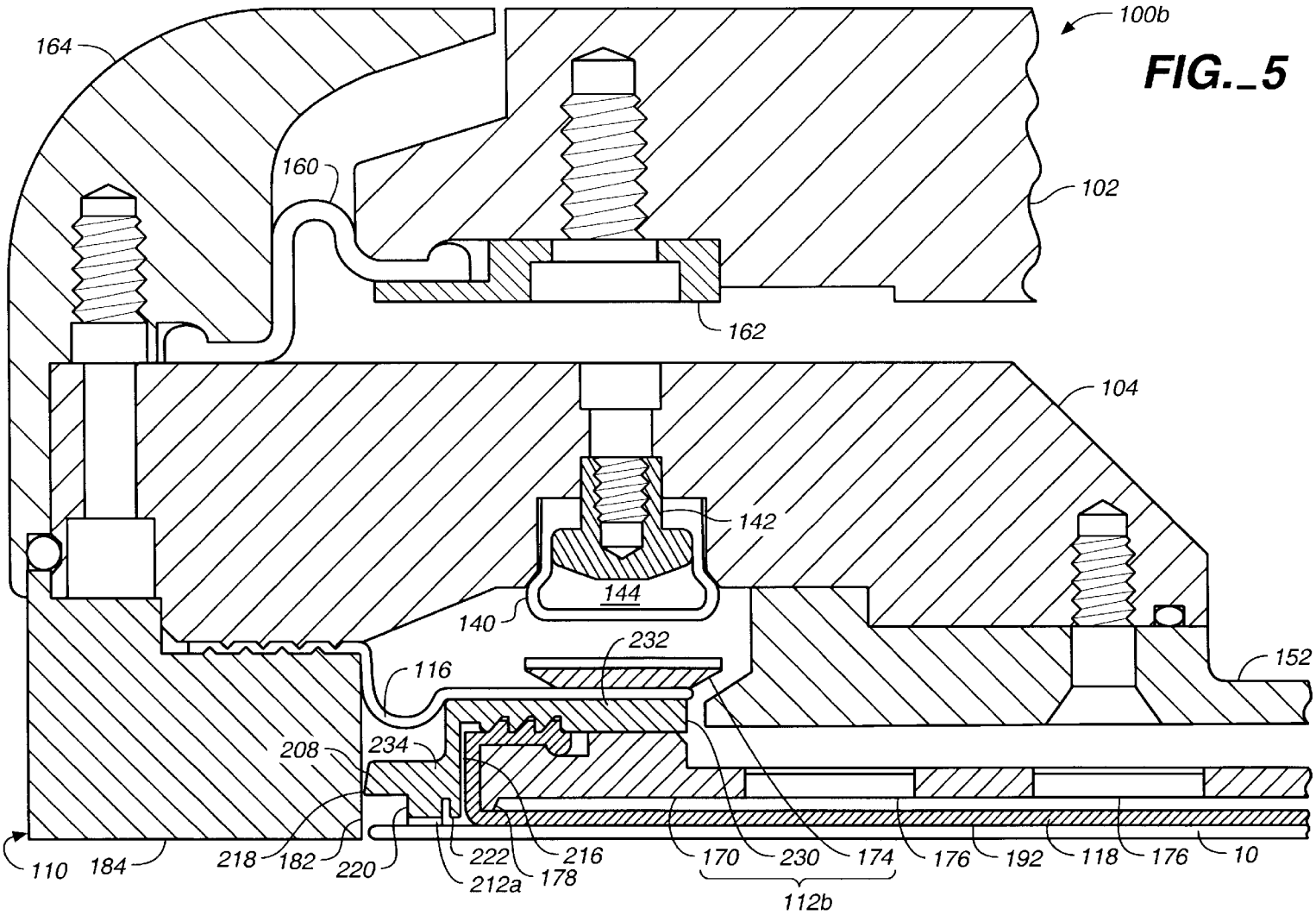
FIG. 5 is a cross-sectional view of a carrier head having an edge-load ring that is secured to the support structure.

Referring to FIG. 5, carrier head 100*b* may include a combined lower clamp and edge-load ring 230. Clamp/load ring 230 includes a generally annular horizontal clamp portion 232 located between upper clamp 174 and support plate 170, and a generally annular loading portion 234 which extends around the edge of support plate 170. Loading portion 234 includes projection 220 and flange 222, which serve the same purpose as the elements in carrier head 100*a*. Pressurization of chamber 190 applies a downward force to flexible membrane 118 and clamp/load ring 234 to apply a pressure to the central and perimeter portions of the substrate, respectively. In addition to creating a fluid-tight seal to ensure vacuum-chucking of the substrate, bladder 144 may be used to adjust the pressure applied by loading portion 234 on the substrate perimeter. Specifically, pressurization of bladder 144 causes membrane 140 to expand to contact upper clamp 174 and apply a downward pressure to clamp/load ring 230. This configuration helps ensure that the outward expansion of the flexible membrane does not interfere with the motion of loading portion 234.

Figure 6:
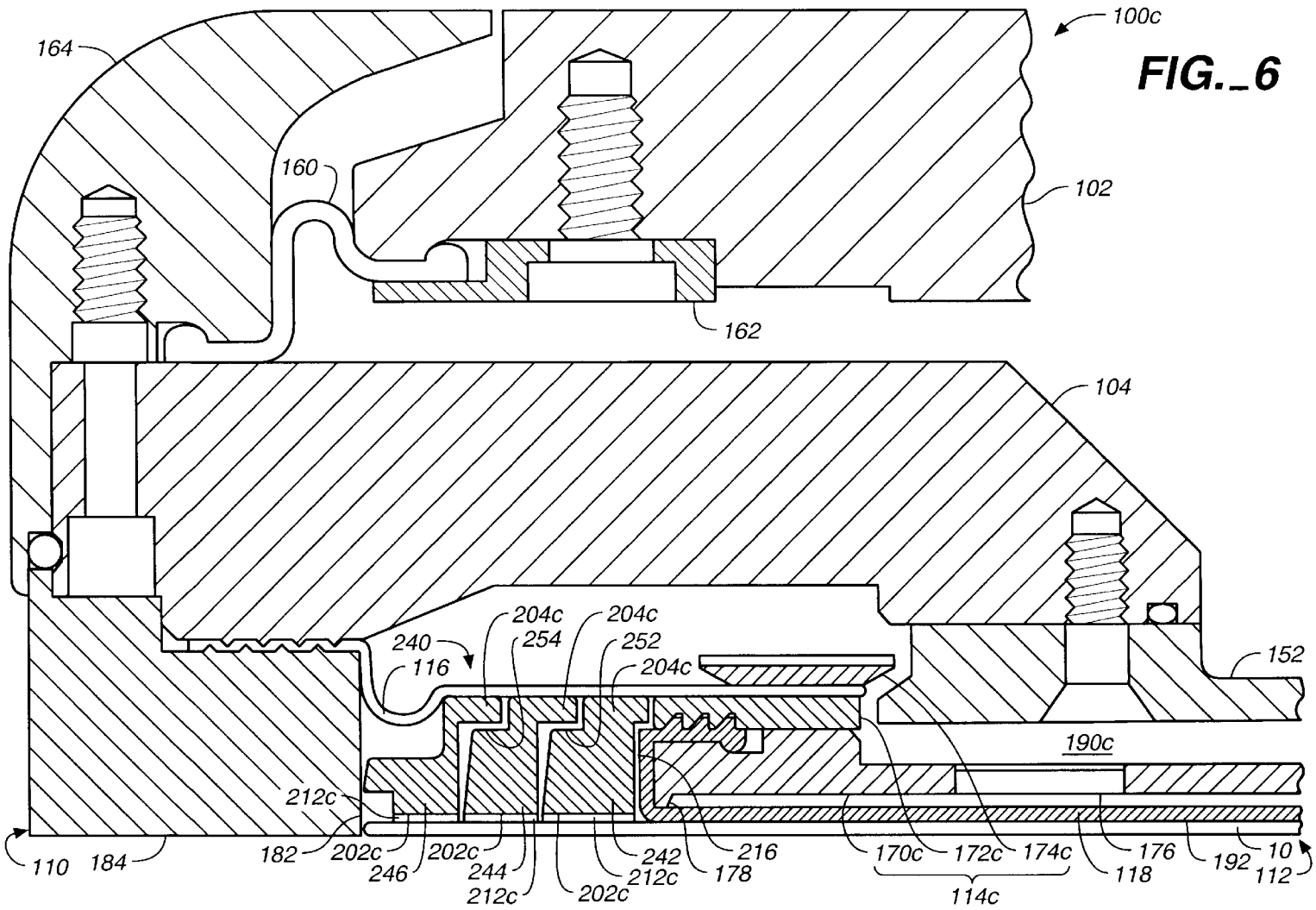
FIG. 6 is a cross-sectional view of a carrier head having a plurality of edge support rings.

Referring to FIG. 6, carrier head 100*c* includes an edge-load ring assembly 240. The edge-load ring assembly 240 has three annular load rings, including an inner load ring 242, a middle load ring 244, and an outer load ring 246. Of course, although edge-load ring assembly 240 is illustrated with three load rings, it may have two, or four or more load rings. In addition, the inner load ring may be combined with the clamp ring. Carrier head 100*c* is illustrated without a bladder, although it could include a bladder positioned above upper clamp 174 or edge-load ring assembly 240.

Each load ring includes a lower surface 202*c* for applying a downward pressure on an annular perimeter portion of the substrate, and a rim portion 204*c* which extends inwardly from the main body of the load ring. The rim portion of inner load ring 242 projects over flexible membrane 118. The rim portion of middle load ring 244 projects over a ledge 252 formed in the outer surface of inner load ring 242. Similarly, the rim portion of outer load ring 246 projects over a ledge 254 formed in middle load ring 244. When substrate backing assembly 112 is lifted off the polishing pad by decreasing the pressure in chamber 190*c*, the ledges catch on the rim portions to lift edge-load ring assembly 240 off the polishing pad.

The edge-load ring assembly may be used to adjust the pressure distribution over a plurality of pressure regions. The pressure applied in each region will vary with the pressure in chamber 190*c*, but the pressures applied by load rings 242, 244 and 246 need not be the same. Specifically, the pressure $P_i$ applied by a given edge-load ring may be calculated from the following equation:

$$P_i = \frac{A_{Ui}}{A_{Li}} \cdot P_M$$

assuming that $$\sum_{i=1}^{n} \frac{P_i}{n} = P_M$$

where $A_{Ui}$ is the surface area of upper surface 214*c* which contacts flexure diaphragm 116, $A_{Li}$ is the surface area of lower surface 202*c*, and $P_M$ is the pressure in chamber 190*c*. For example, load rings 242, 244 and 246 may be configured so that $A_{U1}/A_{L1}=1.2$, $A_{U2}/A_{L2}=1.0$, and $A_{U3}/A_{L3}=0.8$. In this case, if the pressure $P_M$ in chamber 190*c* is 5.0 psi, then $P_1$ will be 6.0 psi, $P_2$ will be 5.0 psi, and $P_3$ will be 4.0 psi. Similarly, if $P_M$ is 10.0 psi then $P_1$ will be 12.0 psi, $P_2$ will be 10.0 psi, and $P_3$ will be 8.0 psi. Thus, edge-load ring assembly 240 permits individual control of the pressures applied to different perimeter regions of the substrate while using only a single input pressure from chamber 190*c*. By selecting an appropriate pressure distribution for the different regions of the substrate, polishing uniformity may be improved. If carrier head 240*c* includes a bladder, it may be used to apply additional pressure to the support structure or to one or more of the edge-load rings.

Figure 7A:
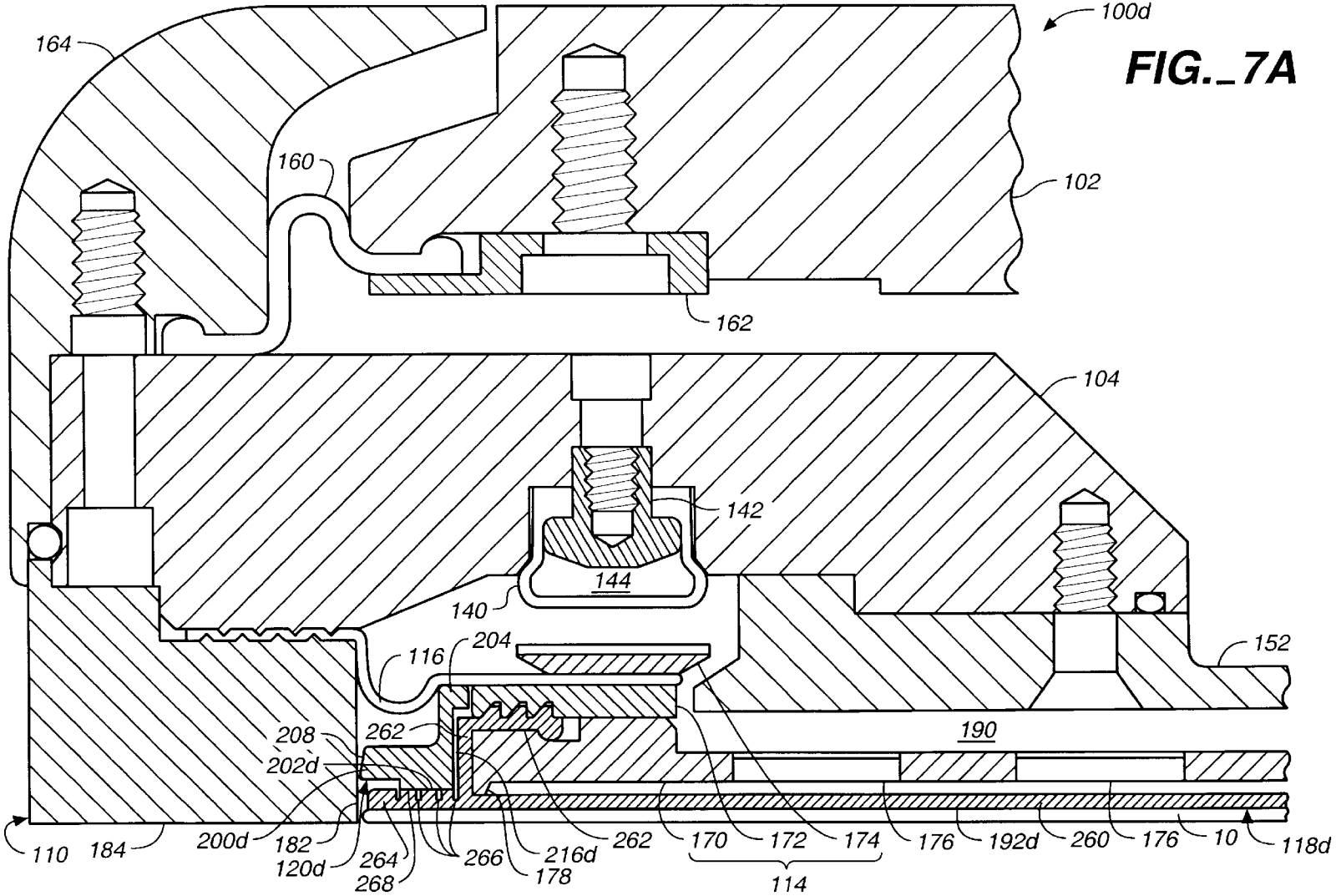
FIG. 7A is a cross-sectional view of a carrier head having a flexible membrane that extends below the edge-load ring.

Referring to FIG. 7A, carrier head 100*d* includes a flexible membrane 118*d* having a central portion 260, an outer portion 262, and an annular flap 264. The outer portion 262 extends between the outer surface of support plate 170 and the inner surface of edge-load ring 120*d* to be clamped between the support plate and lower clamp 172. The flap 264 of flexible membrane 118*d* extends beneath edge-load ring 120*d*, so that lower surface 202*d* rests on an upper surface 268 of the outer portion of flexible membrane 118*d*. A plurality of slots or grooves 266 may be formed in upper surface 268 of flap 264. Grooves 266 provide room for flap 264 to collapse under pressure from edge-load ring 120*d* so as to smooth out the pressure distribution on the edge of the substrate. Carrier head 100*d* does not require a carrier film on the lower surface of the edge-load ring. In addition, when chamber 190 is evacuated, flap 264 may be pulled against substrate 10 to form a seal and improve the vacuum-chucking of the substrate, as described in U.S. patent application Ser. No. 08/09/149,806, by Zuniga, et al., filed Aug. 8, 1998, entitled a CARRIER HEAD FOR CHEMICAL MECHANICAL POLISHING, and assigned to the assignee of the present invention, the entire disclosure of which is hereby incorporated by reference.

Figure 7B:
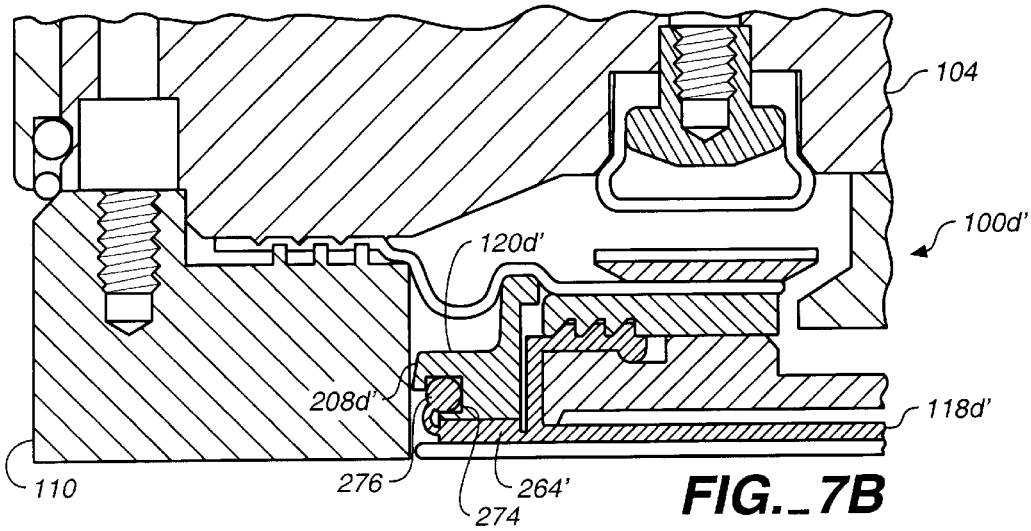
FIG. 7B is a cross-sectional view of a carrier head having a flexible membrane that engages a groove in the edge-load ring.

The flexible membrane may be secured to the edge-load ring, e.g., by a snap-fit, tension-fit, adhesive, or bolting arrangement to prevent the membrane flap from extending too far downwardly when the substrate is to be dechucked from the carrier head. For example, referring to FIG. 7B, flexible membrane 118*d*' may be tension-fit to edge-load ring 120*d*'. An outer surface 208*d*' of edge-load ring 120*d*' includes an annular recess or groove 274, and flap 264' of flexible membrane 118*d*' includes a thick rim portion 276. In an unstretched state, rim portion 276 has a diameter slightly smaller than the diameter of recess 274. However, the flexible membrane can be stretched to slide the rim portion around the outer surface of the edge-load ring until it fits into the annular recess. The tension in the rim portion thus keeps the flexible membrane attached to the edge load ring.

Figure 7C:
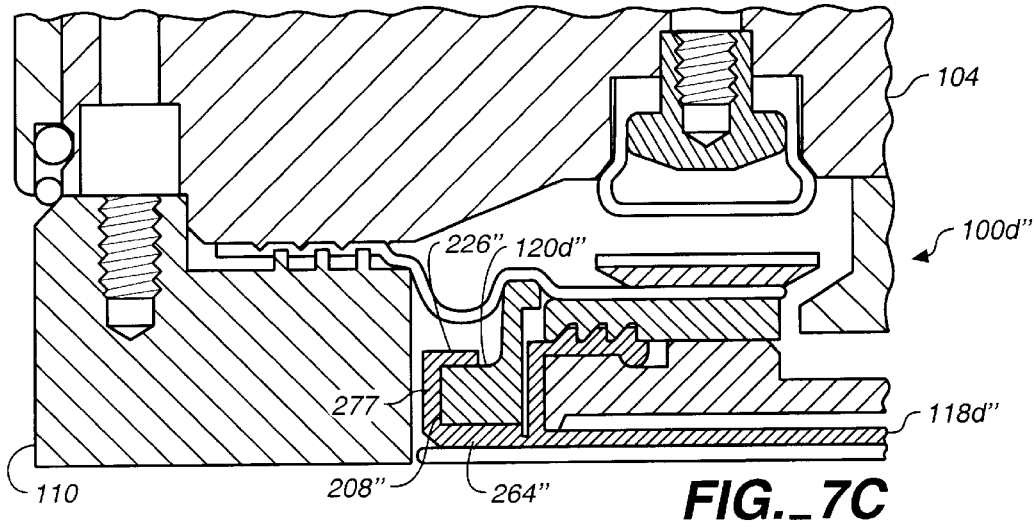
FIG. 7C is a cross-sectional view of a carrier head having a flexible membrane that is extends around the edge-load ring.

Referring to FIG. 7C, flap 264" of flexible membrane 118*d*" includes a flange portion 277 that extends around outer surface 208" and inwardly along upper surface 226" of edge load ring 120*d*". The tensile force in the flange portion keeps the flexible membrane attached to the edge load ring.

Figure 7D:
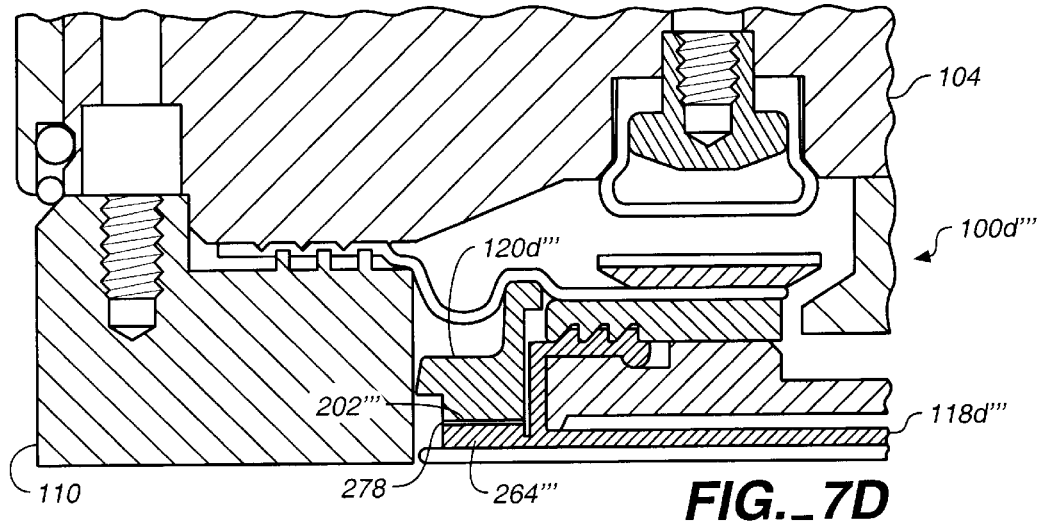
FIG. 7D is a cross-sectional view of a carrier head having a flexible membrane that is adhesively attached to the edge-load ring.

Referring to FIG. 7D, flap 265"' of flexible membrane 118*d*"' may be attached to edge-load ring 120*d*"' with an adhesive layer 278. Specifically, adhesive layer 278 may be placed on the bottom surface 202"' of edge-load ring 120*d*"'. The adhesive may be room temperature vulcanized (RTV) silicone.

Figure 8:
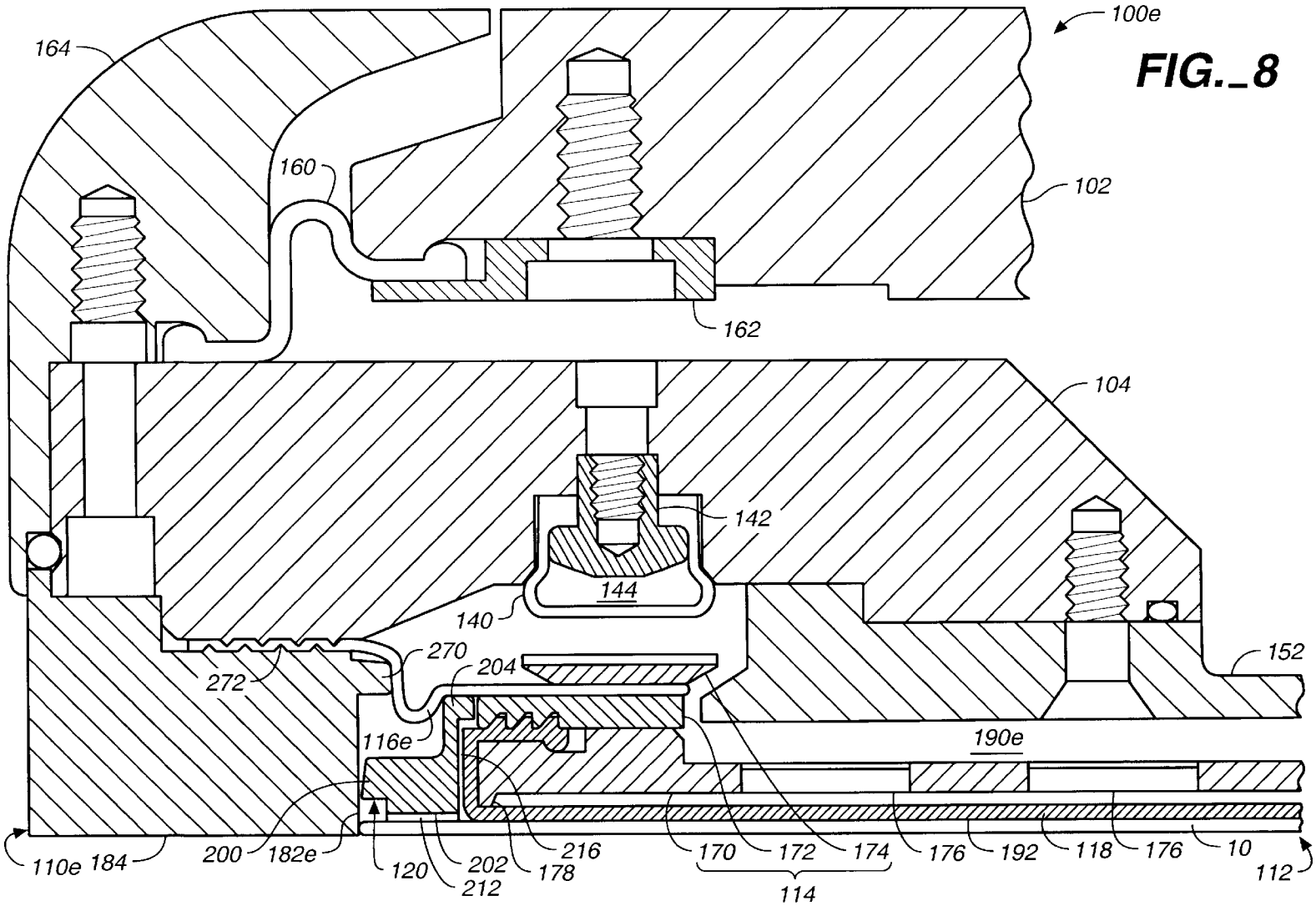
FIG. 8 is a cross-sectional view of a carrier head having a flexure support flange.

Referring to FIG. 8, in carrier head 100*e*, retaining ring 110*e* has a flexure support flange 270 which projects inwardly from inner surface 182*e* of the retaining ring. Flexure support flange 270 is a generally annular projection positioned adjacent to an upper surface 272 of retaining ring 110*e*. Flexure support flange 270 is positioned to support a portion of flexure diaphragm 116*e* that is not clamped between retaining ring 110*e* and base 104.

In operation, when fluid is pumped into chamber 190*e*, a portion of the downward pressure on flexure diaphragm 116*e* is directed to retaining ring 110*e* by flexure support flange 270. Consequently, flexure diaphragm 116*e* exerts less downward force on edge-load ring 120, thereby decreasing the pressure applied to the perimeter portion of the substrate. This occurs in part because flexure support flange 270 absorbs a portion of the downward pressure applied to flexure diaphragm 116*e*. The flexure support flange 270 may be combined with any of the features of the previous implementations.

Figure 9:
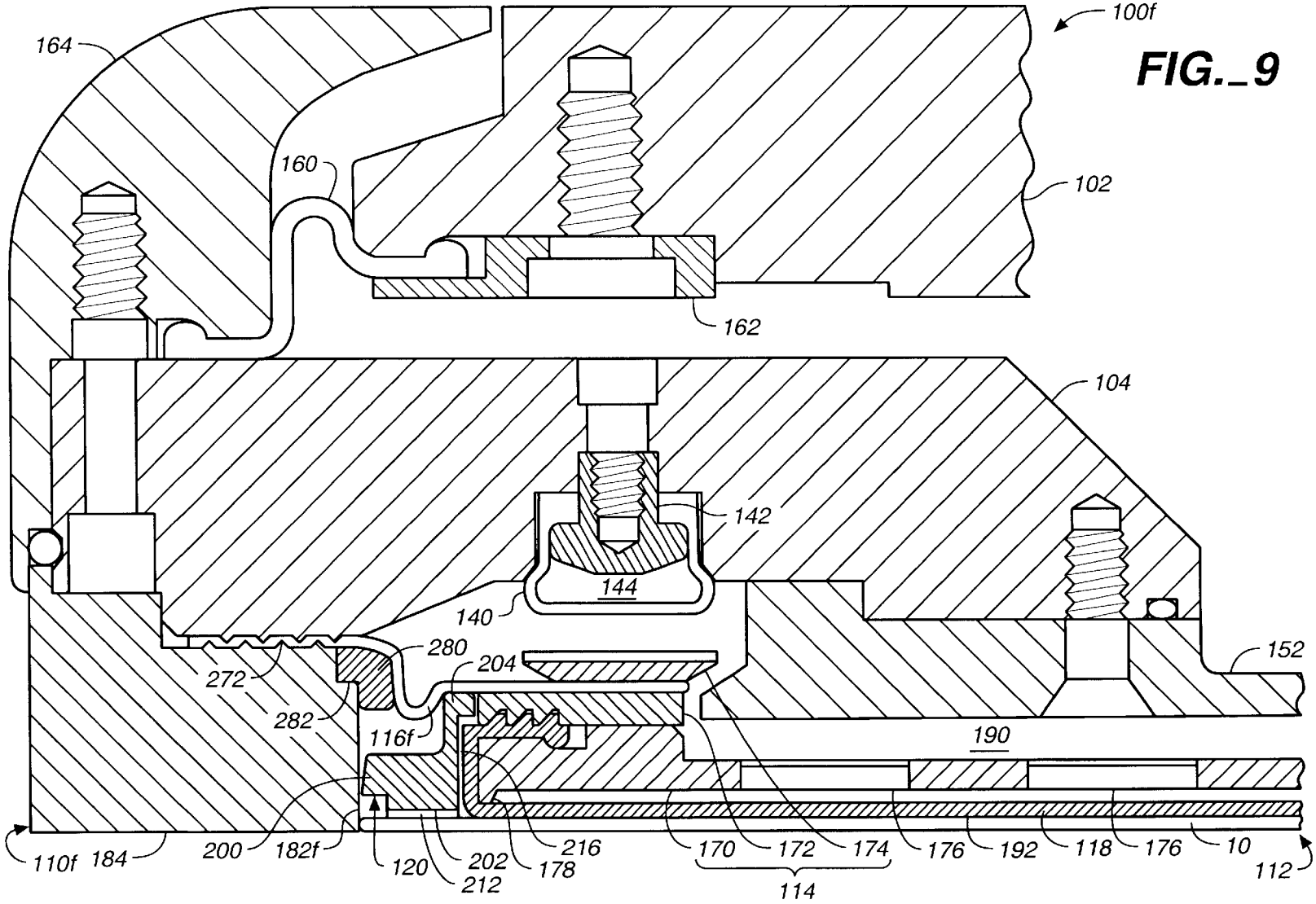
FIG. 9 is a cross-sectional view of a carrier head having a flexure support ring.

Referring to FIG. 9, in carrier head 100*f* the flexure support flange is replaced by a removable flexure support ring 280. In this implementation, retaining ring 110*f* includes a ledge 282 formed in inner surface 182*f* of retaining ring 110*f* near base 104. Flexure support ring 280 is a generally annular member having an L-shaped cross-sectional area which is supported on ledge 282. Flexure support ring 280 provides generally the same function as the flexure support ring discussed above.

Figure 10:
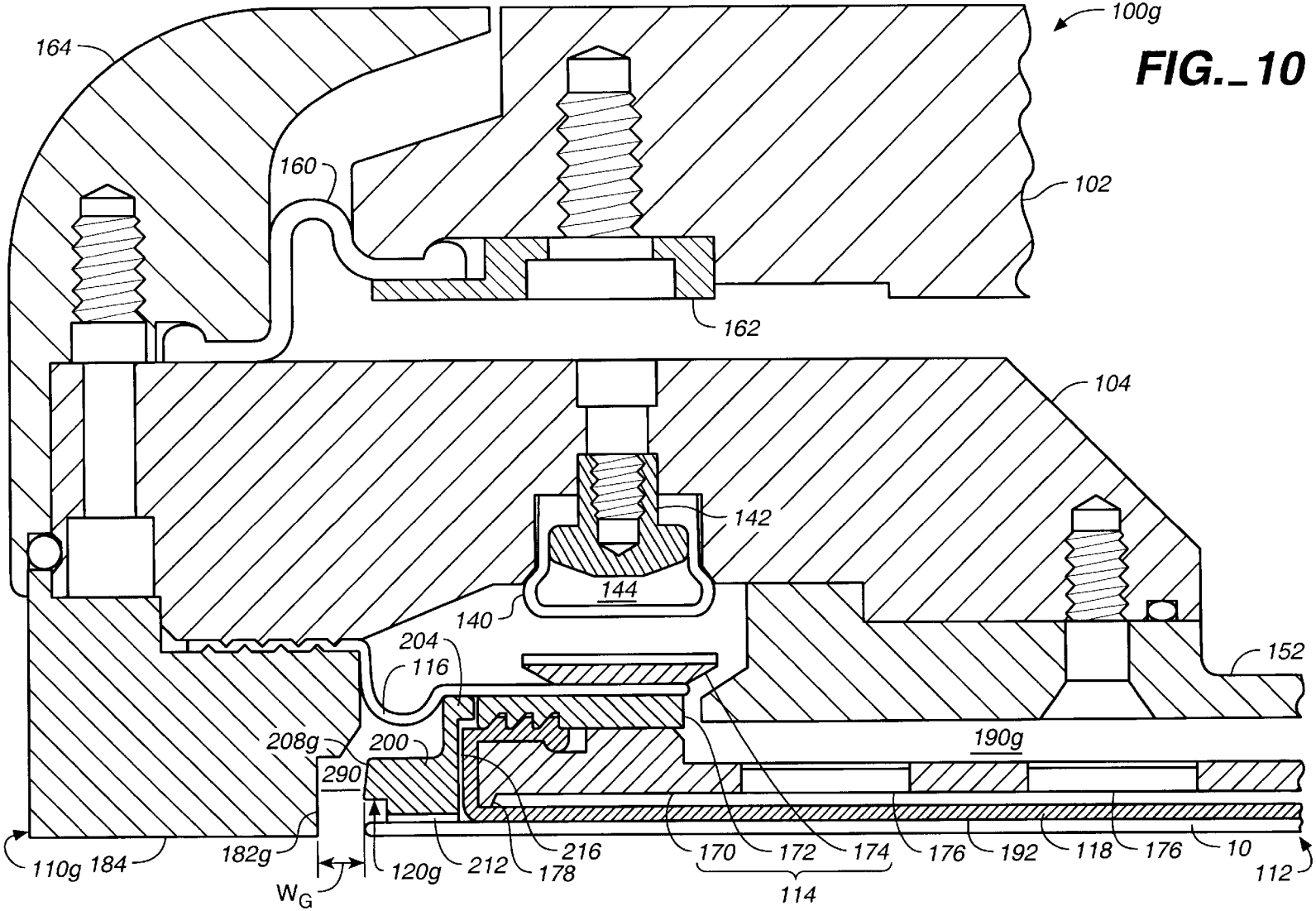
FIG. 10 is a cross-sectional view of a carrier head having a gap between the retaining ring and the edge support ring.

Referring to FIG. 10, in carrier head 100*g*, inner surface 182*g* of retaining ring 110*g* is separated from edge-load ring 120*g* by a gap 290. Gap 290 may have a width $W_G$ of about 2.0 to 5.0 mm. In contrast, in the carrier head of FIGS. 2 and 3, the gap between the edge-load ring and retaining ring will be only about 0.5 to 2.0 mm. During polishing, the frictional force from the polishing pad will urge substrate 10 towards the trailing edge of the carrier head, i.e., in the same direction as the rotational direction of the polishing pad. Due to the presence of gap 290, substrate 10 can slide relative to substrate backing assembly 112. For example, if wafer edge 12 represents the trailing edge of the substrate, then substrate 10 will be urged leftwardly so that trailing edge 12 is located beneath gap 290. On the other hand, the leading edge of the substrate (not shown) will be positioned beneath edge-load ring 120*g*. Consequently, edge-load ring 120*g* will more downward pressure to the leading edge of the substrate than the trailing edge. Since part of the edge effect may be caused by deformation of the substrate where the trailing edge of the substrate is forced against the retaining ring, reducing the pressure on the trailing edge can improve the polishing uniformity.

The features of the various embodiments can be used in combination. In addition, although the advantages of the edge-load ring have been explained for flatted substrates, the carrier head can be used with other sorts of substrates, such as notched wafers. In general, the edge-load ring can be used to adjust the pressure applied to the perimeter portion of a substrate to compensate for non-uniform polishing.

The present invention has been described in terms of a number of embodiments. The invention, however, is not limited to the embodiments depicted and described. Rather, the scope of the invention is defined by the appended claims.

What is claimed is:

1. A carrier head for chemical mechanical polishing, comprising:

a base;

a flexible membrane extending beneath the base to define a pressurizable chamber, a lower surface of the flexible membrane providing a first surface to apply a first load to a center portion of a substrate;

a load ring that is more rigid than the flexible membrane surrounding the first surface, a lower surface of the load ring providing a second surface to apply a second load to perimeter portion of the substrate; and a retaining ring surrounding the load ring to maintain the substrate beneath the first and second surfaces.

2. A carrier head for chemical mechanical polishing, comprising:

a base;

a support structure;

a flexible membrane extending beneath the base to define a pressurizable chamber, a lower surface of the flexible membrane providing a first surface to apply a first load to a center portion of a substrate, wherein the flexible membrane is joined to the support structure, and the support structure is movably connected to the base by a flexure;

an edge load ring surrounding the first surface, a lower surface of the edge load ring providing a second surface to apply a second load to perimeter portion of the substrate; and a retaining ring surrounding the edge load ring to maintain the substrate beneath the first and second surfaces.

3. The carrier head of claim 2, wherein the flexible membrane extends between an outer surface of the support structure and an inner surface of the edge load ring.

4. The carrier head of claim 3, wherein the edge load ring includes a rim portion which abuts the support structure to maintain a gap between the inner surface of the edge load ring and the flexible membrane.

5. The carrier head of claim 2, wherein the edge load ring includes a rim portion which extends over a portion of the support structure.

6. The carrier head of claim 2, wherein a top surface of the edge load ring abuts a lower surface of the flexure.

7. The carrier head of claim 6, wherein pressurization of the chamber applies a downward force on the edge load ring through the flexure.

8. The carrier head of claim 7, wherein the surface area of the top surface of the edge load ring is greater than the surface area of the lower surface of the edge load ring.

9. The carrier head of claim 7, wherein the surface area of the top surface of the edge load ring is less than the surface area of the lower surface of the edge load ring.

10. The carrier head of claim 2, wherein an outer edge of the flexure is clamped between the retaining ring and the base.

11. The carrier head of claim 2, further comprising an annular flexure support joined to the retaining ring and supporting a perimeter portion of the flexure.

12. The carrier head of claim 11, wherein the flexure support is formed as an integral part of the retaining ring.

13. The carrier head of claim 11, wherein the flexure support is removably connected to the retaining ring.

14. The carrier head of claim 2, wherein the edge load ring is joined to the support structure.

15. The carrier head of claim 2, wherein the support structure includes a support plate, a lower clamp, and an upper clamp, the flexible membrane being clamped between the support plate and the lower clamp, the flexure being clamped between the lower clamp and the upper clamp, and the edge load ring being joined to the lower clamp.

16. The carrier head of claim 1, further comprising a layer of compressible material disposed on the lower surface of the load ring.

17. The carrier head of claim 1, wherein the load ring includes a rim portion which extends over the flexible membrane.

18. The carrier head of claim 1, wherein the lower surface of the load ring includes an annular projection having an inner diameter which is larger than an outer diameter of the first surface.

19. The carrier head of claim 18, wherein the load ring includes an annular flange located inwardly of the annular projection and protruding downwardly to prevent the flexible membrane from extending beneath the load ring.

20. The carrier head of claim 1, the load ring is configured to extend over a flat of the substrate.

21. The carrier head of claim 20, wherein the lower surface of the load ring includes an annular projection which extends over at least a portion of the flat.

22. The carrier head of claim 21, wherein $(RI+RO)/2>RF$, where RI represents an inner radius of the annular projection, RO represents an outer radius of the annular projection, and RF represents the minimum distance between the substrate center and the substrate flat.

23. The carrier head of claim 1, further comprising a second load ring that is more rigid than the flexible membrane surrounding the second surface, a lower surface of the second load ring providing a third surface for applying a third load to a second perimeter portion of the substrate.

24. The carrier head of claim 23, further comprising a third load ring that is more rigid than the flexible membrane surrounding the third surface, a lower surface of the third load ring providing a fourth surface for applying a fourth load to a third perimeter portion of the substrate.

25. A carrier head for chemical mechanical polishing, comprising:

a base;

a flexible membrane extending beneath the base to define a pressurizable chamber, a lower surface of the flexible membrane providing a first surface to apply a first load to a center portion of a substrate;

an edge load ring surrounding the first surface, a lower surface of the edge load ring providing a second surface to apply a second load to perimeter portion of the substrate, wherein a portion of the flexible membrane extends beneath the lower surface of the edge load ring; and a retaining ring surrounding the edge load ring to maintain the substrate beneath the first and second surfaces.

26. The carrier head of claim 25, wherein the portion of the flexible membrane extending beneath the lower surface of the edge load ring includes a plurality of grooves.

27. The carrier head of claim 25, wherein the portion of the flexible membrane extending beneath the lower surface of the edge load ring is secured to the edge load ring.

28. The carrier head of claim 1, wherein an outer surface of the edge load ring is separated from an inner surface of the retaining ring by a gap positioned such that frictional forces between the substrate and a polishing pad urge a trailing edge of the substrate into the gap.

29. A carrier head for a chemical mechanical polishing, comprising:

a base;

a flexible membrane extending beneath the base to define a pressurizable chamber, a lower surface of the flexible membrane providing a first surface to apply a first load to a first portion of the substrate; and a rigid member that is movable relative to the base, a lower surface of the rigid member providing a second surface to apply a second load to a second portion of the substrate.

30. A chemical mechanical polishing carrier head part, comprising:

an annular main body portion;

an annular projection extending downwardly from the main body portion and having a lower surface to contact a perimeter portion of a substrate; and a flange portion projecting upwardly from the main body portion and having an inwardly projecting rim to catch on a part of the carrier head.

31. The carrier head of claim 2, wherein the edge load ring is more rigid than the flexible membrane.

32. The carrier head of claim 25, wherein the edge load ring is more rigid than the flexible membrane.

* * * * *